US009084907B2

(12) United States Patent
Kornhaber

(10) Patent No.: US 9,084,907 B2
(45) Date of Patent: Jul. 21, 2015

(54) RETRACTABLE ADJUSTABLE-TRAJECTORY ROOFTOP FIRE SPRINKLER

(71) Applicant: Harvey A. Kornhaber, Truckee, CA (US)

(72) Inventor: Harvey A. Kornhaber, Truckee, CA (US)

( * ) Notice: Subject to any disclaimer, the term of this patent is extended or adjusted under 35 U.S.C. 154(b) by 174 days.

(21) Appl. No.: 14/033,478

(22) Filed: Sep. 22, 2013

(65) Prior Publication Data

US 2015/0083444 A1 Mar. 26, 2015

(51) Int. Cl.

| | |
|---|---|
| ***A62C 3/02*** | (2006.01) |
| ***A62C 31/28*** | (2006.01) |
| ***A62C 13/78*** | (2006.01) |

(52) U.S. Cl.

CPC ..... *A62C 13/78* (2013.01); *A62C 3/0214* (2013.01); *A62C 31/28* (2013.01)

(58) Field of Classification Search

CPC .... A62C 3/0214; A62C 3/0292; A62C 31/02; A62C 31/24; A62C 31/28; B05B 13/0278; B05B 15/061; B05B 15/062; B05B 15/063; B05B 15/065; B05B 15/066; B05B 15/067; B05B 15/069; B05B 15/07; B05B 15/10

See application file for complete search history.

(56) References Cited

U.S. PATENT DOCUMENTS

| | | | | |
|---|---|---|---|---|
| 6,360,968 | B1 * | 3/2002 | Orrange et al. | 239/273 |
| 6,824,073 | B1 * | 11/2004 | Haney | 239/208 |
| 6,964,379 | B2 * | 11/2005 | Crowley | 239/208 |
| 7,673,696 | B1 * | 3/2010 | Gunn | 169/46 |
| 2005/0103507 | A1 * | 5/2005 | Brown | 169/54 |
| 2008/0289830 | A1 * | 11/2008 | Olson | 169/16 |
| 2009/0200044 | A1 * | 8/2009 | Durkin | 169/16 |
| 2010/0071917 | A1 * | 3/2010 | Lalouz | 169/60 |
| 2011/0192616 | A1 * | 8/2011 | Gonzalez | 169/37 |
| 2011/0240761 | A1 * | 10/2011 | Kornhaber | 239/208 |
| 2011/0247842 | A1 * | 10/2011 | Huber | 169/54 |

* cited by examiner

*Primary Examiner* — Darren W Gorman
(74) *Attorney, Agent, or Firm* — Craig A. Simmerman

(57) ABSTRACT

A retractable adjustable-trajectory rooftop fire sprinkler comprising a base component, a lockable flow-through hinge fitting, a trajectory angle setting mechanism, and a sprinkler head. Trajectory angle setting mechanism is a mechanism to adjust, lock, and hold a certain trajectory angle of water flowing from the sprinkler head by allowing the rotation of the lockable flow-through hinge fitting about an axis-of-rotation relative to the base component. Base component and lockable flow-through hinge fitting each further comprise at least one knuckle protrusion with a hinge screw hole located therein. All hinge screw holes are aligned and a hinge pin or a hinge screw is inserted through each hinge screw hole to pivotally attach lockable flow-through hinge fitting to base component. Trajectory angle setting mechanism includes a lockable hinge mechanism, a spring pin and plurality of spring pin holes, and a ratchet mechanism.

8 Claims, 9 Drawing Sheets

RETRACTABLE ADJUSTABLE-TRAJECTORY ROOFTOP FIRE SPRINKLER

BACKGROUND OF THE INVENTION

1. Field of the Invention

This invention relates to rooftop fire sprinklers, which are water sprinklers mounted on a rooftop of a building. Rooftop fire sprinklers function to wet or soak the rooftops of buildings and/or the surrounding grounds of buildings with water emitted from a sprinkler mounted on the rooftop in order to reduce the threat of ignition or burning of the rooftop as a result of flying, windblown, or airborne burning or hot embers landing on the rooftop. Burning or hot embers are known to erupt and blow ahead of a traveling forest or brush fire, sometimes at extremely long distances, thereby spreading the fire to buildings located very far from the source of the forest or brush fire. Specifically, this invention relates to a portable self-contained rooftop fire sprinkler that is externally mounted to a rooftop of a building that does not require any external or internal piping from the building to function other than a standard hose bib connection in the vicinity of the rooftop fire sprinkler. Also, the rooftop fire sprinkler of this invention is retractable and adjustable where the sprinkler head and all other main components can be folded downward, retracted, and covered for protection from the elements when not in use. When use is required, the sprinkler head and all other main components may be uncovered, extracted, or folded upwards, where the trajectory angle of the water flow from the fire sprinkler head may be adjusted to suit a specific roof geometry or specific flying ember threat. Rooftop fire sprinklers of this invention use a special lockable flow-through hinge fitting that is used to connect the sprinkler head and the feed hose where the flow direction of the sprinkler head may be adjusted, set, and locked at any desired trajectory angle.

2. Description of Related Art

There are many rooftop fire sprinklers in the prior art. Most are components of a fixed rooftop fire sprinkler system or set plumbing fixtures integral to the building and coupled to a water source via internal plumbing. This invention is different from all such rooftop fire sprinkler systems because it is a single unit that does not couple to any plumbing fixtures or require any building plumbing or piping to function other than a standard hose bib connection in the vicinity of the rooftop fire sprinkler that is coupled to a water source.

There are other rooftop fire sprinklers in the prior art that do not require fixtures or pipe networks to function, such as, U.S. Pat. Nos. 6,929,071 and 7,673,696. These rooftop fire sprinklers appear to couple to a water source via a flexible hose coupled to a hose bib connection or similar.

However, even these do not include any of the following novel aspects and elements that are a part of this invention. The rooftop fire sprinkler of this invention is retractable so that the sprinkler head and all other components may be retracted, protected, and covered from the elements to keep the rooftop fire sprinkler in good working order for an extended period without concern about degradation from sun, wind, ice, rain, etc. The rooftop fire sprinkler of this invention has the ability to adjust and lock the trajectory angle of water flowing from the sprinkler head. The rooftop fire sprinkler of this invention uses a special "lockable flow-through hinge fitting" to hydraulically connect the sprinkler head of this invention to the feed hose.

BRIEF SUMMARY OF THE INVENTION

Retractable adjustable-trajectory rooftop fire sprinkler 10 comprises: a base component, a lockable flow-through hinge fitting, a hinge screw, a cover component, a sprinkler head, and a feed hose. Retractable adjustable-trajectory rooftop fire sprinkler is a small self-contained sprinkler system that may be quickly mounted on the rooftop of any building. Upon removal of the cover component, the sprinkler head may be retracted from a downward folded storage position to an upward folded ready position and the feed hose may be extracted from its storage position for hydraulic connection to a hose bib connection located on the building. The trajectory angle of the water flow from the sprinkler head may be adjusted along one axis and locked into position using the lockable flow-through hinge fitting and hinge screw. Before and after use, all components of retractable adjustable-trajectory rooftop fire sprinkler may be retracted, folded downward, and stored under cover component for safekeeping from the elements until use is required.

DEFINITION LIST

Figure 1A:
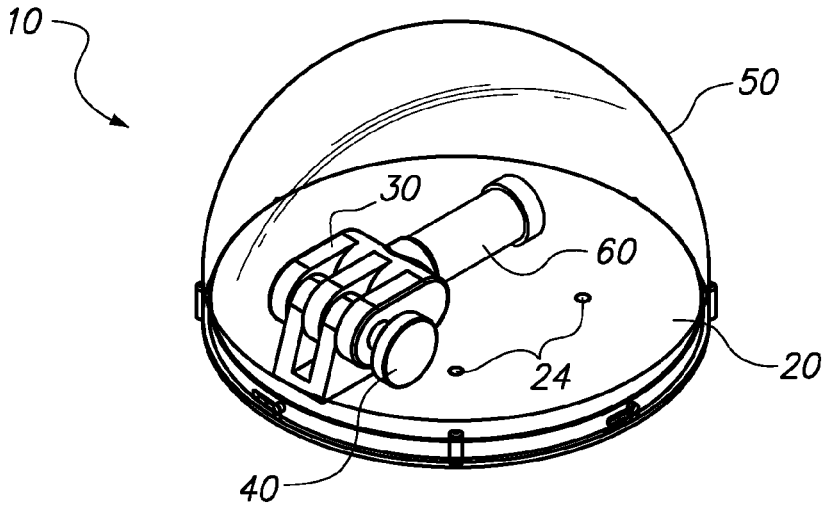
FIG. 1A is a perspective view of best mode retractable adjustable-trajectory rooftop fire sprinkler.
Figure 1B:
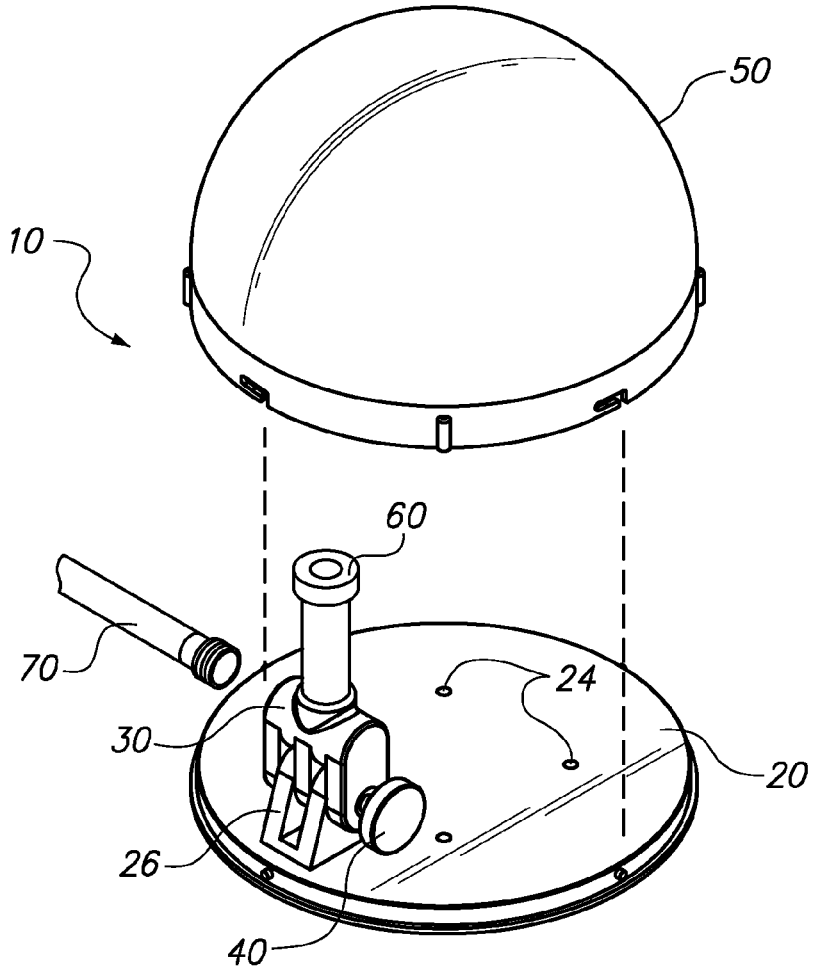
FIG. 1B is an exploded perspective view of best mode retractable adjustable-trajectory rooftop fire sprinkler.
Figure 2A:
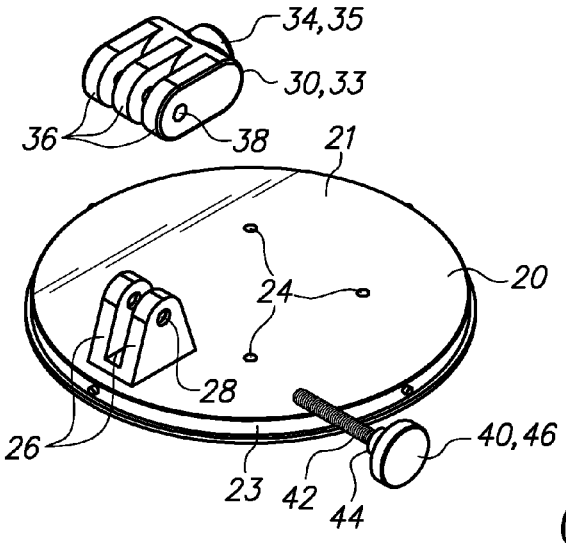
FIG. 2A is an exploded perspective view of best mode retractable adjustable-trajectory rooftop fire sprinkler without the cover component.
Figure 2B:
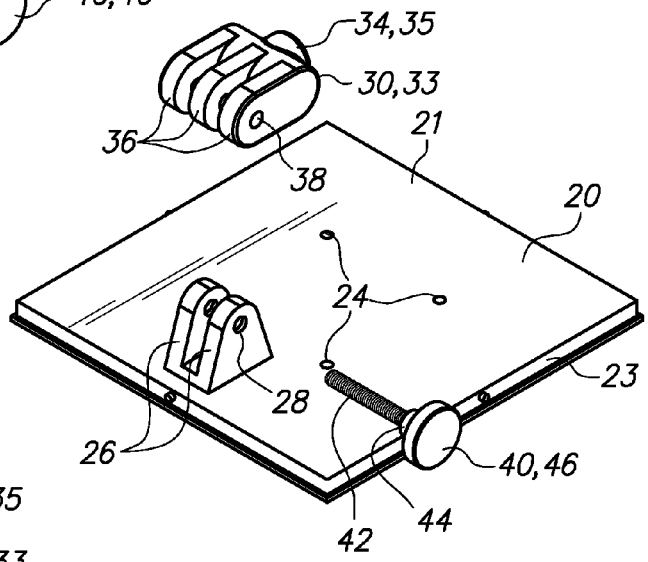
FIG. 2B is an exploded perspective view of retractable adjustable-trajectory rooftop fire sprinkler with a square or rectangular base without the cover component.
Figure 2C:
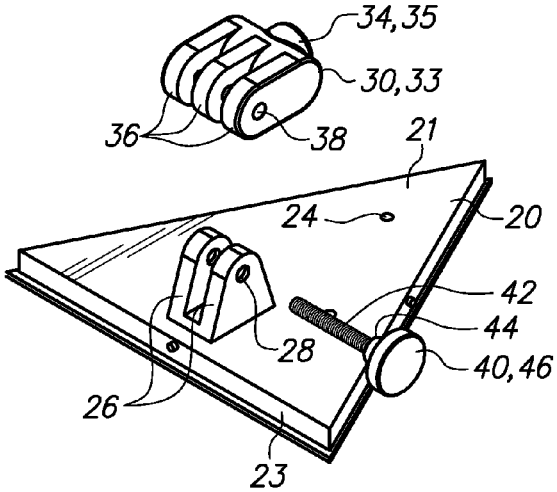
FIG. 2C is an exploded perspective view of retractable adjustable-trajectory rooftop fire sprinkler with a triangular base without the cover component.
Figure 3A:
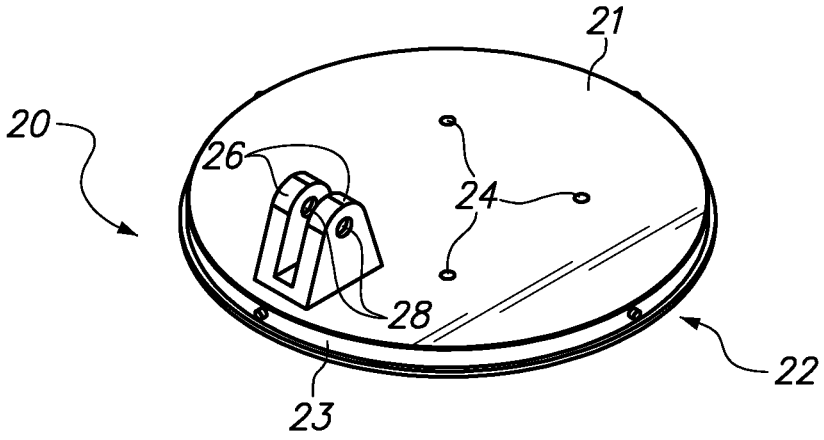
FIG. 3A is a perspective view of best mode base component of retractable adjustable-trajectory rooftop fire sprinkler.
Figure 3B:
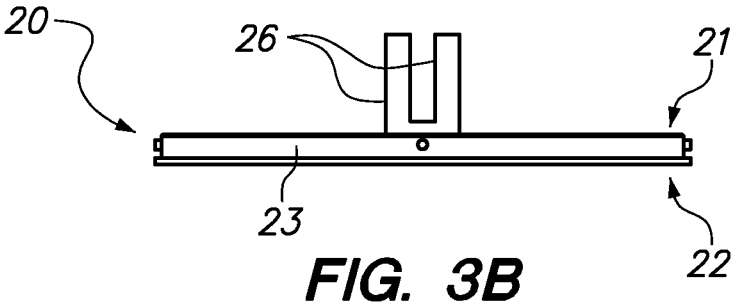
FIG. 3B is a front elevation view of best mode base component of retractable adjustable-trajectory rooftop fire sprinkler.
Figure 3C:
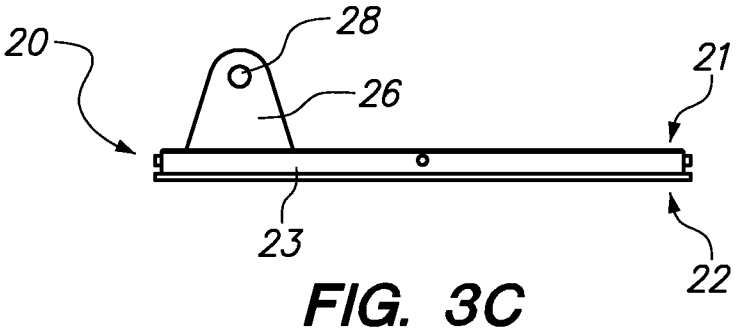
FIG. 3C is a side elevation view of best mode base component of retractable adjustable-trajectory rooftop fire sprinkler.
Figure 4A:
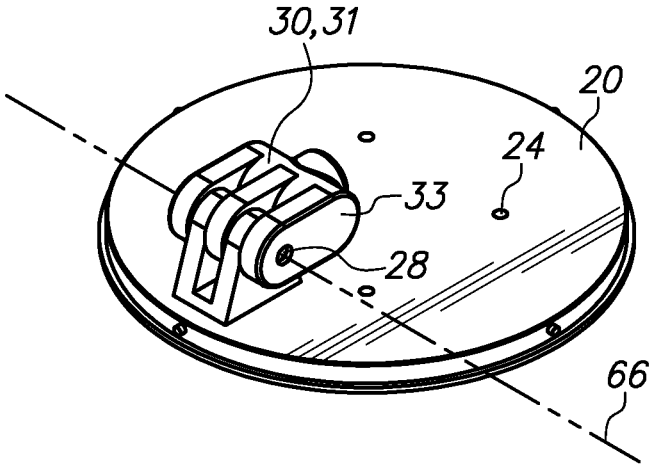
FIG. 4A is a perspective view of best mode lockable flow-through hinge fitting mounted to base component in the retracted position.
Figure 4B:
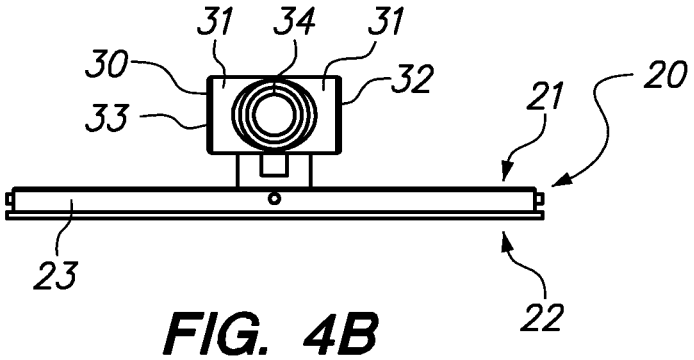
FIG. 4B is a front elevation view of best mode base lockable flow-through hinge fitting mounted to base component in the retracted position.
Figure 4C:
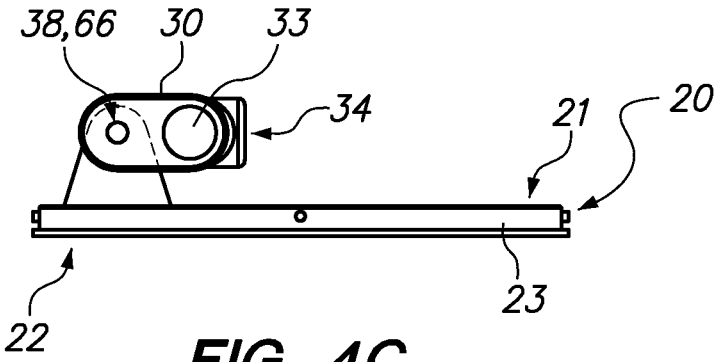
FIG. 4C is a side elevation view of best mode lockable flow-through hinge fitting mounted to base component in the retracted position.
Figure 5A:
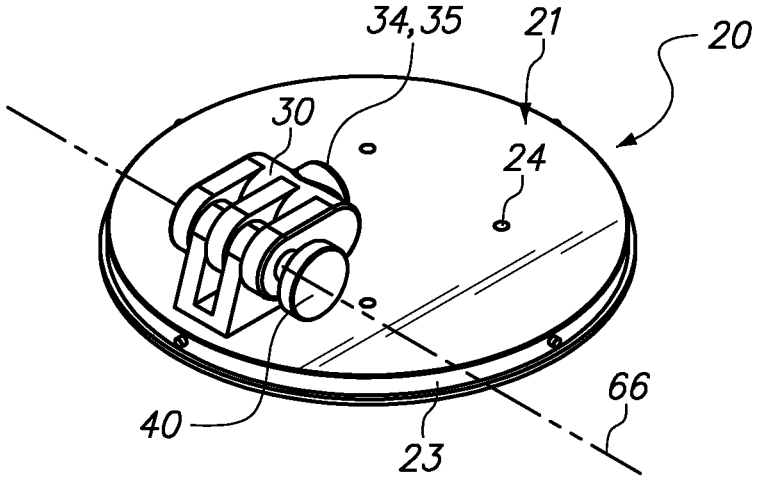
FIG. 5A is a perspective view of best mode lockable flow-through hinge fitting mounted to base component in the retracted position and locked into place by the hinge screw.
Figure 5B:
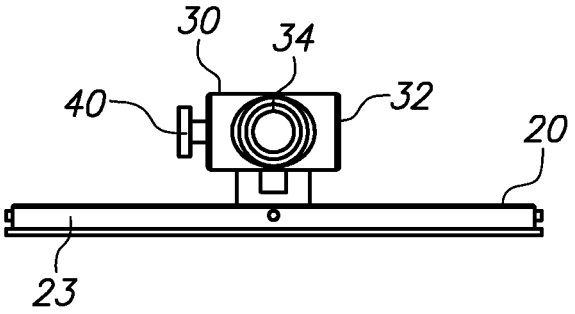
FIG. 5B is a front elevation view of best mode base lockable flow-through hinge fitting mounted to base component in the retracted position and locked into place by the hinge screw.
Figure 5C:
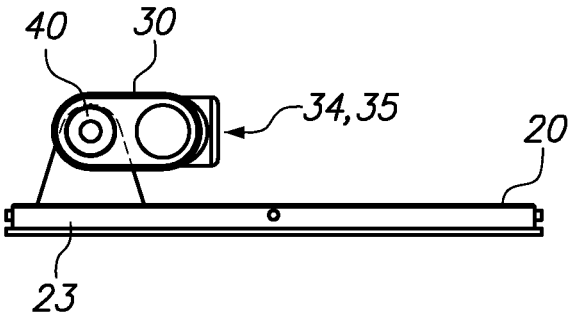
FIG. 5C is a side elevation view of best mode lockable flow-through hinge fitting mounted to base component in the retracted position and locked into place by the hinge screw.
Figure 6A:
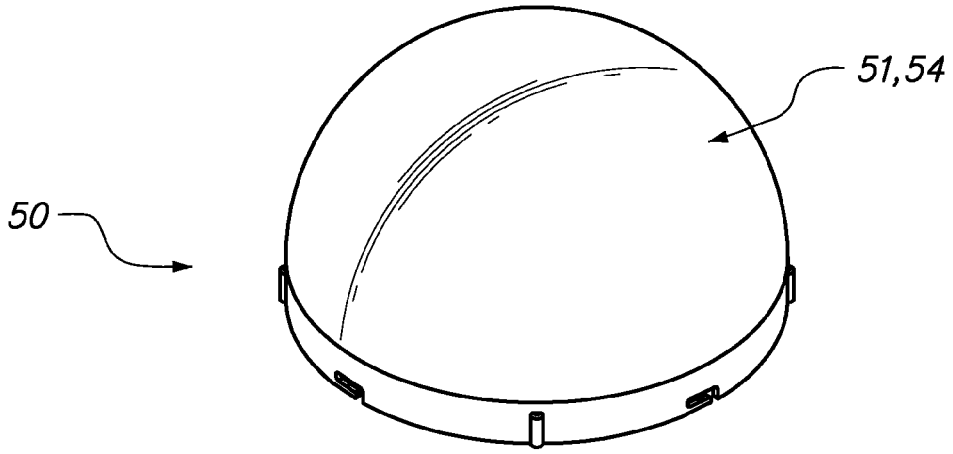
FIG. 6A is a perspective view of best mode cover component.
Figure 6B:
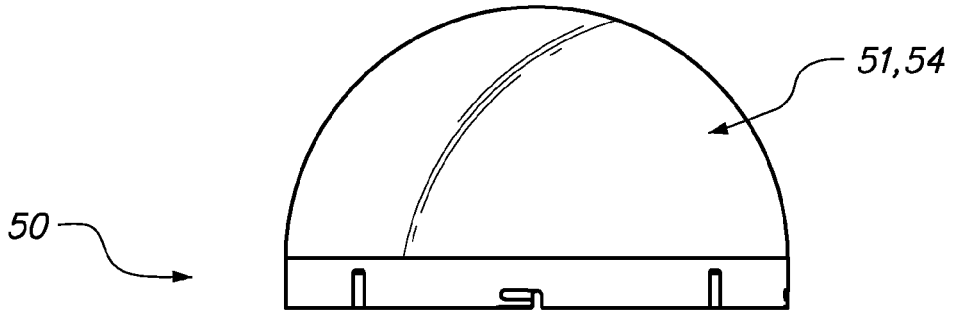
FIG. 6B is a front elevation view of best mode cover component.
Figure 6C:
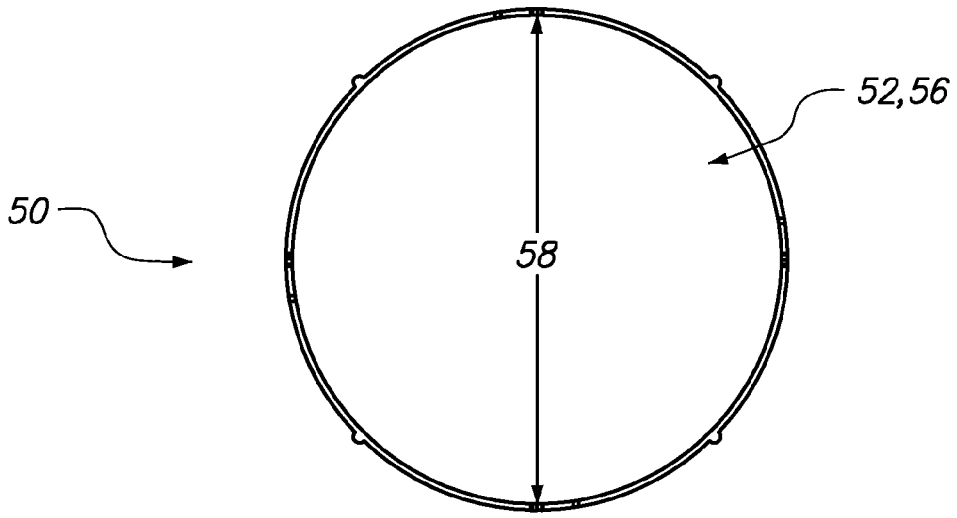
FIG. 6C is a bottom plan view of best mode cover component.

| Term | Definition |
|---|---|
| 10 | Retractable Adjustable-Trajectory Rooftop Fire Sprinkler |
| 20 | Base Component |
| 21 | Upper Surface of Base Component |
| 22 | Lower Surface of Base Component |
| 23 | One or More Outer Edges of Base Component |
| 24 | Mounting Hole |
| 26 | At Least One Base Component Knuckle Protrusion |
| 28 | Hinge Screw Hole in At Least One Knuckle Protrusion 26 |
| 30 | Lockable Flow-Through Hinge Fitting |
| 31 | Fitting Body |
| 32 | Threaded Area for Feed Hose |
| 33 | Closed-End of Fitting Body |
| 34 | Threaded Area for Sprinkler Head |
| 35 | Raised Cylindrical-Shaped Protrusion |
| 36 | At Least One Hinge Fitting Knuckle Protrusion |
| 38 | Hinge Screw Hole in At Least One Knuckle Protrusion 36 |
| 40 | Hinge Screw |
| 42 | Threaded Body |
| 44 | Screw Head |
| 46 | Screw Handle |
| 50 | Cover Component |
| 51 | Closed Top of Cover Component |
| 52 | Open Bottom of Cover Component |
| 54 | Outer Surface of Cover Component |
| 56 | Inner Surface of Cover Component |
| 58 | Overall Inner Dimension of Open Bottom |
| 60 | Sprinkler Head |
| 62 | Rotation of Sprinkler Head |
| 64 | Trajectory Angle of Sprinkler Head |
| 66 | Axis-of-Rotation of Sprinkler Head |
| 70 | Feed Hose |

DETAILED DESCRIPTION OF THE INVENTION

Retractable adjustable-trajectory rooftop fire sprinkler 10 comprises: a base component 20, a lockable flow-through hinge fitting 30, a trajectory angle setting means, and a sprinkler head 60. Retractable adjustable-trajectory rooftop fire sprinkler 10 is a small self-contained sprinkler system that may be quickly mounted on the rooftop of any building. Upon removal of the cover component 50, the sprinkler head 60 may be retracted from a downward folded storage position to an upward folded ready position and the feed hose 70 may be extracted from its storage position for hydraulic connection to a hose bib located on the building. As detailed below, the trajectory angle 64 of the water flow from the sprinkler head 60 may be adjusted along one axis and locked into position using a lockable flow-through hinge fitting 30 and the trajectory angle setting means. Before and after use, all components of retractable adjustable-trajectory rooftop fire sprinkler 10 may retracted, folded downward, and stored under cover component 50 for safekeeping from the elements until use is required.

Base component 20 comprises a rigid flat solid planar member with an upper surface 21, a lower surface 22, and one or more outer edges 23. Said one or more outer edges 23 has an overall outer dimension or dimensions. Base component 20 must be rigid, solid, and sturdy because it is mounted to the rooftop of the building and all components of retractable adjustable-trajectory rooftop 10 are mounted upon its upper surface 21, where all should remain firmly intact and attached through all types of weather for a period of many years. Base component 20 must be air-tight and water-tight so as to prevent such from penetrating through the base component 20 from lower surface 22 and into the protected area on upper surface 21. In best mode, base component 20 is disk-shaped, and, thus, has only one outer edge 23 traveling around the entire edge or circumference of the disk shape. However, base component may be of any particular shape, such as, square, rectangular, triangular, pentagonal, etc. A triangular-shaped base component 20 has three outer edges 23, a square-shaped base component 20 has four outer edges 23, and so on. Disk-shaped is considered best mode because there are no corners for the wind to catch onto or the weather to degrade.

Base component 20 further comprises one or more mounting holes 24. Each mounting hole 24 is a hole or void in the rigid planar member of base component 20. Each mounting hole 24 is sized to accept mounting screws so that the screw body will pass through the mounting hole 24 while the screw head interferes with the mounting hole 24 to prevent it from passing through. In best mode, there are 4 mounting holes 24 in base component 20.

To mount base component 20 to a rooftop, cover component 50, sprinkler head 60, and feed hose 70 should first be removed from the assembly. Base component 20 should be placed on the rooftop at a strategic location to defend from fire with its upper surface 21 positioned upwards and its lower surface 22 positioned downwards. A strategic location to defend from fire would be a position from which sprinkler head 60 may wet the entire surface of the roof of your building, taking into account both the rotation of the sprinkler head 62 and the trajectory angle of sprinkler head 64. Alternately, a strategic location to defend from fire could be a position from which sprinkler head 60 may wet a portion of rooftop along with a portion of the grounds around the building. A retractable adjustable-trajectory rooftop fire sprinkler 10 could be placed, for instance, at the corners of a rooftop to create a wet or damp defensible area of ground around your building to further protect your property from fire. Testing may be required to determine a strategic location. More than one retractable adjustable-trajectory rooftop fire sprinkler 10 may be required to wet the entire rooftop of a building. Base component 20 is mounted to a rooftop by inserting and fastening a fastening screw (not depicted) through each mounting hole 24. Attachment occurs from the screw body of fastening screw penetrating through the roofing surface material to anchor into the roofing substrate, pulling the head of the fastening screw down onto the upper surface 21 of base component 20 to tightly clamp the base component 20 down onto the rooftop. Typically, roofing substrate is wood, so, typically, wood screws are used to mount base component 20 to a rooftop. Alternately, masonry screws may be used to mount base component 20 to a masonry roof.

Base component 20 further comprises at least one base component knuckle protrusion 26. At least one base component knuckle protrusion 26 is a rigid planar member extending vertically upwards from the upper surface 21 of base component 20. Each base component knuckle protrusion 26 is an oblong shaped member with an upper end and a lower end. Each base component knuckle protrusion 26 is integral to the rigid flat solid planar member of base component 20 or otherwise rigidly and sturdily connected to the rigid flat solid planar member of base component 20 at its lower end. Each base component knuckle protrusion 26 is used to mount lockable flow-through hinge fitting 30, and thereupon, sprinkler head 60 and feed hose 70 are mounted, so each base component knuckle protrusion 26 must remain rigid, sturdy, and attached to base component 20 for a period of many years without failure or degradation from wear or weather. In best mode, there are two base component knuckle protrusions 26 on each base component 20.

At least one base component knuckle protrusion 26 has a hinge screw hole 28 located at its upper end. Hinge screw hole 28 is a cylindrical-shaped void or hole in the rigid planar member of each base component knuckle protrusion 26 where the hole or void is sized to accept and allow passage there through of the threaded body 42 of hinge screw 40 but disallow passage and interfere with screw head 44 of hinge screw 40. Hinge screw hole 28 is a cylindrical hole running laterally through each base component knuckle protrusion and parallel to the plane of base component 20. The inner surface of the cylindrical hole is a cylindrical bearing surface or barrel bearing for hinge screw 40 to rotate within, to form a hinge bearing between hinge screw hole 28, hinge screw hole 38, and hinge screw 40. Circular void or hole of hinge screw hole 28 is sized to allow a slip fit or clearance fit with threaded body 42 of hinge screw 40. In the event of two or more base component knuckle protrusions 26, each base component knuckle protrusion 26 with screw hole 28, must be positioned so that each screw hole 28 on each base component knuckle protrusion 26 is exactly concentric with each other along one axis, which is the axis-of-rotation of the sprinkler head 66. This alignment insures smooth operation of the hinge bearing. Axis-of-rotation 66 runs parallel to the plane of base component 20.

Lockable flow-through hinge fitting 30 comprises: a fitting body 31, a threaded area for feed hose 32, a threaded area for sprinkler head 34, and at least one hinge fitting knuckle protrusion 36. Lockable flow-through hinge fitting 30 is, in itself, a pipe fitting, capable of containing pressurized fluid flow and hydraulically connecting feed hose 70 to sprinkler head 60 to allow for pressurized water flow from feed hose 70 to sprinkler head 60 without leaking or other failure of lockable flow-through hinge fitting 30.

Fitting body 31 is a rigid, solid, hollow cylindrical member with a closed end 33, an open end, an interior surface, and an exterior surface. Fitting body 31 must be capable of containing pressurized fluid flow and hydraulically connecting feed hose 70 to sprinkler head 60 to allow for pressurized water flow from feed hose 70 to sprinkler head 60 without leaking or failure. Closed end 33 of cylindrical member is closed and integral to hollow cylindrical member or otherwise rigidly connected to cylindrical member to contain pressurized fluid flow within without failure or leaking.

The open end of cylindrical member is the threaded area for feed hose 32. Threaded area for feed hose 32 comprises screw thread or threads used for threaded attachment of a fitting or a hose to lockable flow-through hinge fitting 30. Threads are inscribed ridges wrapped in a helical cylindrical fashion at the open end of cylindrical member, either along the interior surface or exterior surface of fitting body 31, with axis of orientation of threads in line with the longitudinal axis of cylindrical member of fitting body 31. Threaded area for feed hose 32 is either a female threaded connector or a male threaded connector. Best mode thread style for threaded area for feed hose 32 is Garden Hose Thread or GHT. In best mode, threaded area for feed hose 32 is female GHT, which is sized to accept the male end of any standard garden hose for home use. However, as stated, threaded area for feed hose 32 may be of any particular size or type of thread, male or female. In order to form enough threads for threaded area for feed hose 32, the open end of cylindrical member may have a thicker wall thickness than that of fitting body 31, in order to provide sufficient base material on which to inscribe sufficient threads for a strong and sturdy threaded connection to feed hose 70.

Threaded area for sprinkler head 34 is a cylindrical-shaped void or hole in the side of fitting body 31. Pressurized liquid flows through threaded area for sprinkler head 34 in order to flow into sprinkler head 60. Threaded area for sprinkler head 34 must contain pressurized fluid flow without failure or leaking. Threaded area for sprinkler head 34 comprises a raised cylindrical-shaped protrusion 35 protruding from the side of fitting body 31 with longitudinal axis perpendicular to that of fitting body 31. Raised cylindrical-shaped protrusion 35 is open on each end and has an interior surface and an exterior surface. Threaded area for sprinkler head 34 is a threaded connector to connect sprinkler head 60 by threaded attachment. Threaded area for sprinkler head 34 comprises screw thread or threads used for threaded attachment of a fitting or a sprinkler head 60 to lockable flow-through hinge fitting 30. Threads are inscribed ridges wrapped in a helical cylindrical fashion on raised cylindrical-shaped protrusion 35, either along the interior or exterior surface of raised cylindrical-shaped protrusion 35, with axis of orientation of threads perpendicular to the longitudinal axis of cylindrical member of fitting body 31. Threaded area for sprinkler head 34 is either a female threaded connector or a male threaded connector. Best mode is a female threaded connector because most sprinkler heads 60 available in the market come standard with a male threaded connector. In order to inscribe enough threads for a strong and sturdy threaded connection to sprinkler head 34, the raised cylindrical-shaped protrusion 35 may have a thicker wall thickness than that of fitting body 31. This is to provide sufficient base material on which to inscribe sufficient threads for a strong and sturdy threaded connection to sprinkler head 60.

At least one hinge fitting knuckle protrusion 36 is a rigid planar member extending radially outwards from the exterior surface of fitting body 31 with longitudinal axis perpendicular to that of fitting body 31. At least one hinge fitting knuckle protrusion 36 is an oblong shaped member with an upper end and a lower end. Each hinge fitting knuckle protrusion 36 is integral to fitting body 31 or otherwise rigidly and sturdily connected to fitting body 31 at its lower end. Each hinge fitting knuckle protrusion 36 is used to mount lockable flow-through hinge fitting 30 onto base component 20, so each hinge fitting knuckle protrusion 36 must remain rigid, sturdy, and attached to fitting body 31 for a period of many years without failure or degradation from wear or weather. In best mode, there are three hinge fitting knuckle protrusions 36 on each base component 20.

At least one hinge fitting knuckle protrusion 36 has a hinge screw hole 38 located at its upper end. Hinge screw hole 38 is a cylindrical-shaped void or hole in the rigid planar member of each hinge fitting knuckle protrusion 36 where the void or hole is sized to accept and allow passage there through of the threaded body 42 of hinge screw 40 but disallow passage of and interfere with screw head 44 of hinge screw 40. Hinge screw hole 38 is a cylindrical hole running laterally through each hinge fitting knuckle protrusion 36 with longitudinal axis parallel to that of fitting body 31. The inner surface of the cylindrical hole is a cylindrical bearing surface or barrel bearing for hinge screw 40 to rotate within, to form a hinge bearing between hinge screw hole 28, hinge screw hole 38, and hinge screw 40. Circular void or hole of hinge screw hole 38 is sized to allow a slip fit or clearance fit with threaded body 42 of hinge screw 40 to pass there through. In the event of two or more hinge fitting knuckle protrusions 36, each hinge fitting knuckle protrusion 36 with screw hole 38, must be positioned so that each screw hole 38 of each hinge fitting knuckle protrusion 36 is exactly concentric with each other, along one axis, which is the axis-of-rotation of the sprinkler head 66. This alignment insures smooth operation of the hinge bearing. Axis-of-rotation 66 runs parallel to the longitudinal axis of fitting body 31.

Trajectory angle setting means is a means to adjust and lock trajectory angle 64 by allowing the rotation of lockable flow-through hinge fitting 30 about axis-of-rotation 66. Best mode trajectory setting means is a lockable hinge mechanism as detailed below.

Figure 8A:
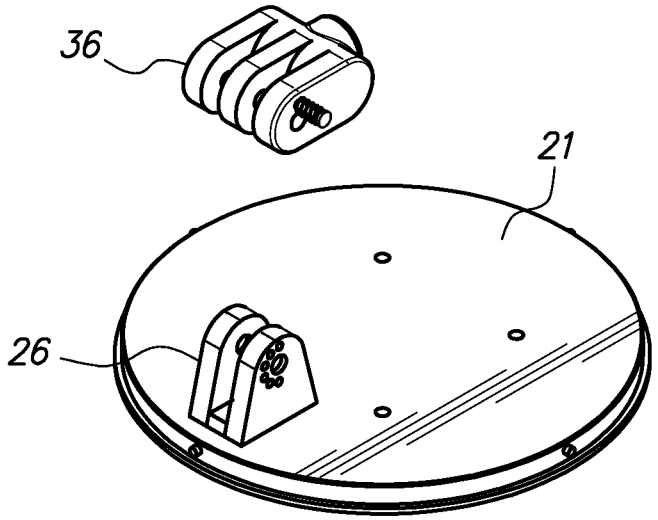
FIG. 8A is an exploded perspective view of lockable flow-through hinge fitting and base component using a spring pin and a plurality of spring pin holes to set and lock a certain trajectory angle of the sprinkler head.

Alternately, trajectory setting means could comprise of a spring pin and a plurality of spring pin holes where at least one base component knuckle protrusion 26 further comprises a plurality of spring pin holes and at least one hinge fitting knuckle protrusion 36 further comprises a spring pin as depicted in FIG. 8A. Alternately, at least one base component knuckle protrusion 26 could further comprise the spring pin and at least one hinge fitting knuckle protrusion 36 could further comprise the plurality of spring pin holes (not depicted). To operate this trajectory angle setting means, the spring pin is held back against the spring action to remove it from one of the plurality of spring pin holes so that the trajectory angle 64 may be moved, adjusted, and set, where upon the spring pin is then released so the spring pin may then spring back into one of the plurality of spring pin holes to lock and hold the desired trajectory angle 64. With this trajectory angle setting means, a hinge pin is used to pivotally connect at least one base component knuckle protrusion 26 to at least one hinge fitting knuckle protrusion 36. Hinge pin is a rigid, solid, cylindrical-shaped member with outer diameter that slightly smaller than the inner diameter of hinge screw holes 28, 38 so that hinge pin may be pressed into and inserted through hinge screw holes 28, 38 to from a slip fit connection staying lodged inside hinge screw holes 28, 38.

Figure 8B:
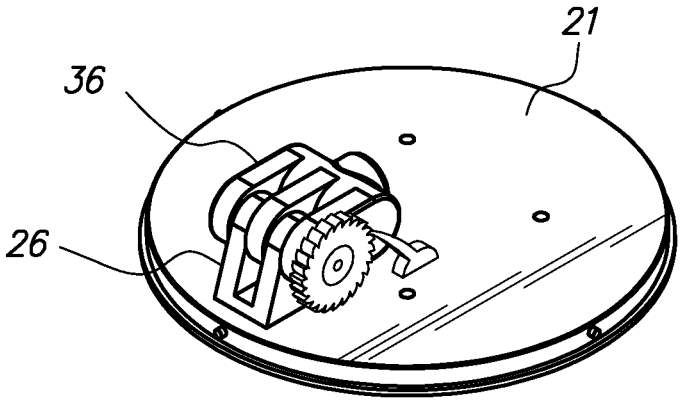
FIG. 8B is an exploded perspective view of lockable flow-through hinge fitting and base component using a ratchet mechanism to set and lock a certain trajectory angle of the sprinkler head.

Alternately, trajectory angle setting means could comprise of a ratchet mechanism where at least one hinge fitting knuckle protrusion 36 further comprises a ratchet wheel with notches or catches along the circumference of the wheel and base component 20 further comprises a ratchet pawl as depicted in FIG. 8B. Alternately, at least one knuckle hinge fitting protrusion 36 could further comprise the ratchet pawl and base component 20 could further comprise the ratchet wheel with notches or catches along the circumference of the wheel (not depicted). To operate this trajectory setting means, the ratchet pawl is held back against its spring action to remove it from a catch in the ratchet wheel so that the trajectory angle 64 may be moved, adjusted, and set, where upon the ratchet pawl is then released so that the ratchet pawl may spring back into a catch in the ratchet wheel to lock and hold the desired trajectory angle 64. With this trajectory angle setting means, a hinge pin is used to pivotally connect at least one base component knuckle protrusion 26 to at least one hinge fitting knuckle protrusion 36. Hinge pin is a rigid, solid, cylindrical-shaped member with outer diameter that slightly smaller than the inner diameter of hinge screw holes 28, 38 so that hinge pin may be pressed into and inserted through hinge screw holes 28, 38 to from a slip fit connection lodged inside hinge screw holes 28, 38.

Best mode trajectory setting means is a lockable hinge mechanism. Lockable hinge mechanism comprises at least one base component knuckle protrusion 26, at least one hinge fitting knuckle protrusion 36, and a hinge screw 40. Hinge screw 40 comprises: a threaded body 42 and a screw head 44. Threaded body 42 is a solid rigid cylindrical member with an upper end, a lower end, and screw threads or threads running along the side of cylindrical member. Screw head 44 is a solid rigid cylindrical member with an upper and lower end. Screw head lower end is integral with, or rigidly attached to, the upper end of threaded body 42. The diameter of threaded body 42 is sized to form a slip fit or clearance fit within hinge screw hole 28 and hinge screw hole 38. All hinge screw holes 28 and hinge screw holes 38 are the same size. The diameter of screw head 44 is larger than that of threaded body 42, hinge screw hole 28, and hinge screw hole 38, so that screw head 44 interferes with and will not pass through hinge screw hole 28 or hinge screw hole 38. Optionally, hinge screw 40 may further comprise a screw handle 46. Screw handle is a rigid cylindrical member with an upper and lower end. Screw handle lower end is integral with, or rigidly attached to screw head upper end. Screw handle 46 has a larger diameter than that of screw head 44. The purpose of screw handle 46 is to provide a larger area for the operator's hand to grab onto in order to make it easier for the operator to loosen or tighten hinge screw 40 as discussed below.

As stated above, retractable adjustable-trajectory rooftop fire sprinkler 10 comprises at least one base component knuckle protrusion 26 and at least one hinge fitting knuckle protrusion 36. Together with hinge screw 40, these members form a hinge bearing. As stated, alternately, retractable adjustable-trajectory rooftop fire sprinkler 10 may function with additional knuckle protrusions 26 or 36 such as: two base component knuckle protrusions 26 and one hinge fitting knuckle protrusion 36; two base component knuckle protrusions 26 and two hinge fitting knuckle protrusions 36; one base component knuckle protrusion 26 and two hinge fitting knuckle protrusions 36; or any number of protrusions 26 and 36 that is more than one each.

In the event of two or more hinge fitting knuckle protrusions 36, all hinge fitting knuckle protrusions 36 are placed in a row, equidistant from each other, like teeth on a hair comb. In the event of two or more hinge fitting knuckle protrusions 36, each knuckle protrusion 36 is separated from adjacent knuckle protrusions 36 by a distance that is just slightly larger than the width of each base component knuckle protrusion 26, so that each base component knuckle protrusion 26 forms a slip fit or clearance fit in the space between adjacent hinge fitting knuckle protrusions 36.

In the event of two or more base component knuckle protrusions 26, all base component knuckle protrusions 26 are placed in a row, equidistant from each other, like teeth on a hair comb. In the event of two or more base component knuckle protrusions 26, each base component knuckle protrusion 26 is separated from adjacent base component knuckle protrusions 26 by a distance that is just slightly larger than the width of each hinge fitting knuckle protrusion 36, so that each hinge fitting knuckle protrusion 36 forms a slip fit or clearance fit in the space between adjacent base component knuckle protrusions 36.

In order to align hinge screw holes 28 with hinge screw holes 38 for insertion of hinge screw 40 to form the hinge bearing between these members, base component knuckle protrusions 26 must slip between hinge fitting knuckle protrusions 36 and vice versa so that hinge screw holes 28 and 38 are concentric as stated above. The insertion of one or more base component knuckle protrusions 26 between one or more hinge fitting knuckle protrusions 36 is similar to pressing together two hair combs with the teeth side of each facing each other just enough for the tips of the teeth to overlap each other. After all hinge screw holes 28 and all hinge screw holes 38 are aligned, hinge screw 40 is inserted through all hinge screw holes 28 and all hinge screw holes 38, and the hinge bearing is formed. The slip fit or clear fit between knuckle protrusions 26 and 36 allow the hinge bearing to rotate or pivot.

In order for this hinge bearing to be "lockable", one hinge screw hole 28 or, optionally, one hinge screw hole 38, must be tapped to accept threaded body 42 of hinge screw 40. Thus, this one hinge screw hole 28 or 38 is not sized to accept and allow passage there through of the threaded body 42 as stated above but rather is a tapped hole sized to accept threaded body 42 of hinge screw 40 by rotational or threaded attachment. The one tapped hinge screw hole must be located on the particular knuckle protrusion, whether a base component knuckle protrusion 26 or a hinge fitting knuckle protrusion 36, that is positioned on the opposite end of screw head 44 on hinge screw 40 upon assembly of the hinge bearing. When the opposite hinge screw hole, 28 or 38, is tapped to accept hinge screw 40, the tightening or clockwise rotation of hinge screw 40 causes screw head 44 to squeeze against the opposite knuckle protrusion or end knuckle protrusion, 26 or 36, in which the tapped screw hole is located, to clamp against screw head 44, to squeeze together all other knuckle protrusions 26 and 36 because they are located between the end knuckle protrusion (with the tapped hole) and the screw head. This clamping pressure causes the hinge bearing to lock together and stay fixed at any desired degree of rotation of the hinge bearing. Knuckle protrusions 26 and 36 clamp against each other to immobilize the hinge bearing and lock it in place. With this design, the hinge screw 40 may be loosened to adjust the hinge bearing to any trajectory angle 64 desired, and then the hinge screw 40 may be tightened to lock the hinge bearing in place.

The degree of rotation of the hinge bearing is the trajectory angle of sprinkler head 64. The trajectory angle of sprinkler head 64 is adjusted and set by adjusting and setting the degree of rotation of this hinge bearing. The trajectory angle of sprinkler head 64 may be adjusted and set anywhere from 0 to 180 degrees inclusive. When lockable flow-through hinge fitting 30 is retracted and folded all the way down onto base component 10 in storage position, the trajectory angle of sprinkler head 64 is at zero degrees. When lockable flow-through hinge fitting 30 is extracted and folded upwards to a position perpendicular to the plane of base component 10, the trajectory angle of sprinkler head 64 is ninety degrees.

Sprinkler head 60 is a sprinkler head, nozzle, or other fitting that is designed to emit water. Sprinkler head 60 is a hollow vessel capable of containing the pressurized flow of liquid there through. Sprinkler head 60 has one or more holes in one end through which water may flow there through and a male or female threaded connector at the other end through which water may flow there through. There are many types of sprinkler heads 60 available on the market. As stated, sprinkler head 60 may have a female threaded connector or male threaded connector and thus may connect to lockable flow-through hinge fitting 30 using either configuration. Sprinkler head 60 is removeably attached to lockable flow-through hinge fitting 30 by threaded connection.

In best mode, sprinkler head 60 is a rotating sprinkler head. Sprinkler head 60 must rotate as water flows through it so that sprinkler head 60 continuously rotates a full 360 degrees over and over again without stopping the rotation where the lockable flow-through hinge fitting remains stationary and does not rotate with sprinkler head 60. The rotation of sprinkler head is denoted by item 62 in the patent figures. Sprinkler head rotation 62 has importance when sprinkler head 60 produces a water flow that is not perpendicular to the longitudinal axis of fitting body 31, or when sprinkler head is not a straight-flow design as depicted. When sprinkler head 60 produces a water flow that is perpendicular to the longitudinal axis of fitting body 31 or is straight-flow design, sprinkler head rotation 62 will not increase the wet area of the rooftop. Sprinkler head 62 is depicted in straight-flow design to denote genericy where any sprinkler head may be used with this invention.

There are many types of sprinkler heads 60 available on the market that rotate as water is flowing through it. A rotating sprinkler head 60 allows for much more wetting capacity over a non-rotating sprinkler head. The rotation of sprinkler head is denoted by item 62 in the patent figures. Some of the least costly rotating sprinkler heads in the market come standard with a male threaded connector. This is why the best mode threaded area for sprinkler head 34 is a female threaded connector.

Retractable adjustable-trajectory rooftop fire sprinkler 10 further comprises a feed hose 70. Feed hose 70 is a length of flexible hose with an interior, exterior, a female threaded connector on one end, and a male threaded connector on the other end. Feed hose 70 is a watertight hose capable of containing the pressurized flow of liquid there through without leaking or failing. Feed hose 70 is removeably attached by threaded connection to lockable flow-through hinge fitting 30 at threaded area for feed hose 32.

Retractable adjustable-trajectory rooftop fire sprinkler 10 further comprises a cover component 50. Cover component 50 is a rigid solid cover or bonnet with a closed top 51 and an open bottom 52. Closed top 51 of cover component 50 has an outer surface 54 and an inner surface 56. Open bottom 52 of cover component 50 has an outer surface 54 and an inner surface 56. Cover component 50 is large enough to completely cover base component 20, lockable flow-through hinge fitting 30, hinge screw 40, sprinkler head 60, and feed hose 70 in a compacted or coiled position. Cover component 50 is impermeable to air, water, and sun and must remain so for years and years. Cover component 50 covers and protects all components of retractable adjustable-trajectory rooftop fire sprinkler 10 from degradation from the weather.

Cover component 50 is removeably attachable to base component 20 with an overlapped press fit connection that is achieved as follows. Open bottom 58 of cover component 50 has an overall inner dimension 58. Overall inner dimension 58 must be sized to mate with and just slip over the overall outer dimension or dimensions of one or more outer edges 23 of said base component 20 so that open bottom 58 slides over one or more outer edges 23 to make a press fit connection to base component 20. Base component 20 acts as the male end that connects with a female end that is the open bottom 52 of cover component 54. The overlapped connection occurs because one or more outer edges 23 has an overall outer dimension that just slightly smaller than the overall inner dimension 58 of open bottom 52 of cover component 50. With such an overlapped connection, water, wind, and sun cannot seep into or enter into the inner cavity protected by cover component 50. All weather that may impinge upon the outer surface 54 of cover component 50 will be reflected or diverted away from the inner surface 56 of cover component 50 by this overlapped connection.

Figure 7A:
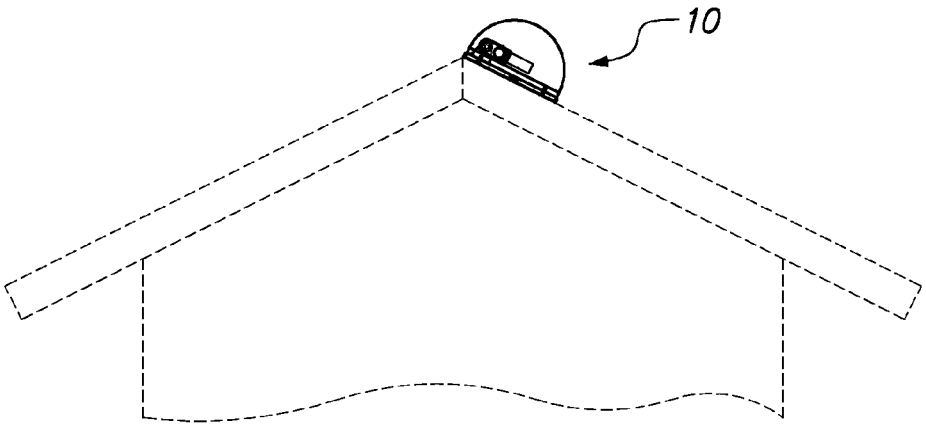
FIG. 7A is a side elevation view of a building with best mode retractable adjustable-trajectory rooftop fire sprinkler attached to the rooftop of the building and in the retracted position with cover component attached.
Figure 7B:
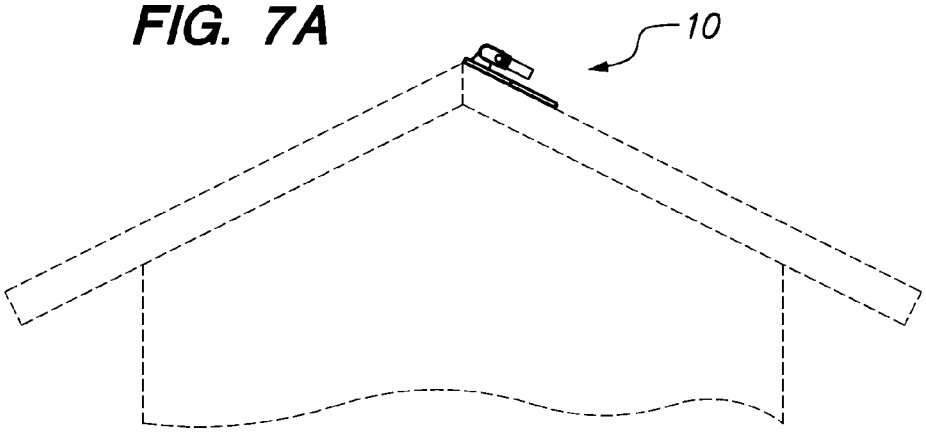
FIG. 7B is a side elevation view of a building with best mode retractable adjustable-trajectory rooftop fire sprinkler attached to the rooftop of the building and in the retracted position with cover component removed.
Figure 7C:
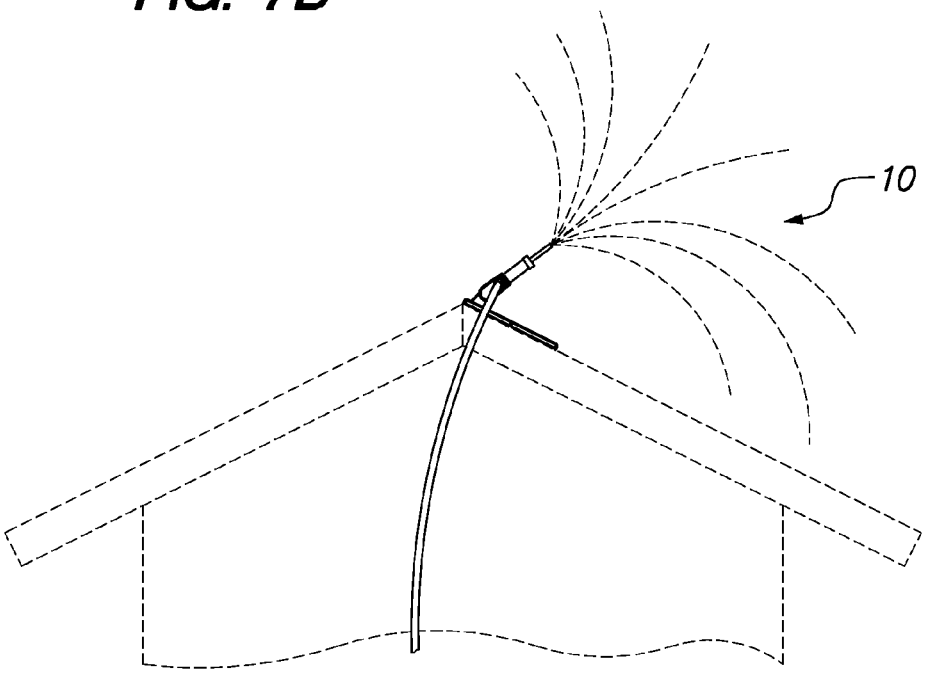
FIG. 7C is a side elevation view of a building with best mode retractable adjustable-trajectory rooftop fire sprinkler attached to the rooftop of the building with sprinkler head in an extracted position and feed hose extended downward for connection with the hose bib.
Figure 7D:
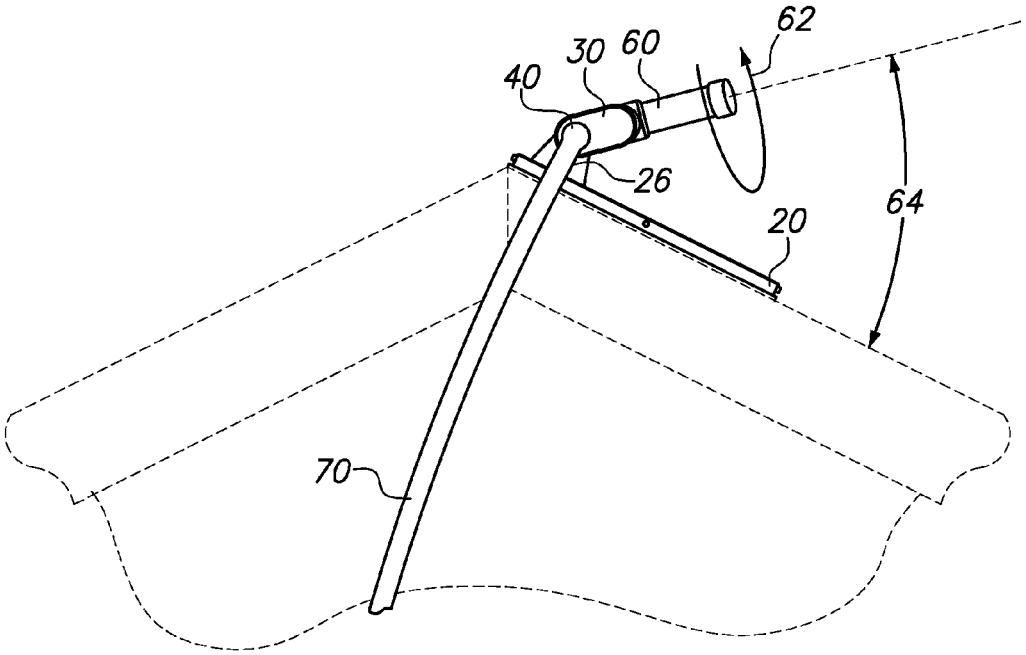
FIG. 7D is a blow-up view of FIG. 7C depicting the rotation of the sprinkler head and the trajectory angle of the sprinkler head.

FIG. 7A depicts retractable adjustable-trajectory rooftop fire sprinkler 10 in the retracted position with all important components securely covered and protected by cover component 50. FIG. 7B depicts retractable adjustable-trajectory rooftop fire sprinkler 10 with cover member 50 removed and trajectory angle 64 of sprinkler head set at about zero degrees. FIG. 7C depicts retractable adjustable-trajectory rooftop fire sprinkler 10 with cover member 50 removed and trajectory angle 64 of sprinkler head set at about 50 degrees, which is a trajectory angle 64 that wets the entire rooftop of this particular roof's shape or geometry.

What is claimed is:

1. A retractable adjustable-trajectory rooftop fire sprinkler, comprising:

a base component;

a lockable flow-through hinge fitting;

a trajectory angle setting means; and a sprinkler head, wherein:

said base component comprises a rigid flat solid planar member with an upper surface, a lower surface, one or more outer edges, an overall outer dimension, and at least one base component knuckle protrusion;

said at least one base component knuckle protrusion comprises a rigid oblong planar member extending vertically upwards from said upper surface of said base component with a cylindrical-shaped void or hole there through that is a hinge screw hole;

said lockable flow-through hinge fitting comprises a fitting body, a threaded area for a feed hose, a threaded area for said sprinkler head, and at least one hinge fitting knuckle protrusion;

said fitting body comprises a rigid, solid, hollow cylindrical member with a closed end, an open end, an interior surface, an exterior surface, and a longitudinal axis;

said open end of said fitting body has threads inscribed either along said interior surface or said exterior surface of said fitting body which is said threaded area for a feed hose;

said threaded area for said sprinkler head comprises a raised cylindrical-shaped protrusion protruding from said exterior surface of said fitting body with a longitudinal axis perpendicular to that of said fitting body;

said raised cylindrical-shaped protrusion has two open ends, an interior surface, and an exterior surface;

said raised cylindrical-shaped protrusion has threads inscribed either along said interior surface or said exterior surface of said raised cylindrical-shaped protrusion;

said at least one hinge fitting knuckle protrusion comprises a rigid oblong planar member extending radially outward from said exterior surface of said fitting body with a longitudinal axis that is perpendicular to that of said fitting body, and a cylindrical-shaped void or hole there through that is a hinge screw hole;

said hinge screw hole in said at least one base component knuckle protrusion and said hinge screw hole in said at least one hinge fitting knuckle protrusion are the same size;

said lockable flow-through hinge fitting is pivotally attached to said base component by aligning said hinge screw hole in said at least one base component knuckle protrusion with said hinge screw hole in said at least one hinge fitting knuckle protrusion and placing a hinge pin through both said hinge screw holes, wherein said hinge pin is a rigid, solid cylindrical-shaped member with an outer diameter sized to form a slip fit or clearance fit within said hinge screw hole in said at least one base component knuckle protrusion and said hinge screw hole in said at least one hinge fitting knuckle protrusion;

said trajectory angle setting means is a means to adjust the trajectory angle of water flowing from said sprinkler head by allowing the rotation of said sprinkler head relative to said base component along at least one axis of movement thereby allowing the adjustment of the trajectory angle of water flowing from said sprinkler head and the locking or holding of a certain trajectory angle of water flowing from said sprinkler head;

said sprinkler head is a hollow vessel capable of containing a pressurized flow of liquid there through, and has one or more holes in one end through which water may flow there through, and a male or female threaded connector at an opposite end thereof, through which water may flow there through; and said sprinkler head is removeably attached to said lockable flow-through hinge fitting by threaded connection at said threaded area for said sprinkler head.

2. A retractable adjustable-trajectory rooftop fire sprinkler as recited in claim 1, wherein said trajectory angle setting means comprises: a spring pin and a plurality of spring pin holes; wherein said at least one base component knuckle protrusion further comprises a plurality of said spring pin holes and said at least one hinge fitting knuckle protrusion further comprises said spring pin, or wherein said at least one base component knuckle protrusion further comprises said spring pin and said at least one hinge fitting knuckle protrusion further comprises said plurality of spring pin holes; and wherein each of said plurality of spring pin holes is parallel with each other and longitudinally aligned with said spring pin.

3. A retractable adjustable-trajectory rooftop fire sprinkler as recited in claim 1, wherein said trajectory angle setting means comprises: a ratchet mechanism; wherein said at least one hinge fitting knuckle protrusion further comprises a ratchet wheel that is a solid rigid disk with notches or catches along the circumference of the disk; and wherein said base component further comprises a ratchet pawl that is a biased lever that springs towards said ratchet wheel and catches in one of said notches of said ratchet wheel, or wherein said at least one knuckle hinge fitting protrusion further comprises said ratchet pawl, and said base component further comprises said ratchet wheel.

4. A retractable adjustable-trajectory rooftop fire sprinkler as recited in claim 1, further comprising: a feed hose; wherein said feed hose is a length of flexible watertight hose capable of receiving the pressurized flow of liquid there through; wherein said feed hose has a female threaded connector on one end and a male threaded connector on an opposite end thereof; and wherein said feed hose is removeably attached to said lockable flow-through hinge fitting by a threaded connection at said threaded area for a feed hose.

5. A retractable adjustable-trajectory rooftop fire sprinkler, comprising:

a base component;

a lockable flow-through hinge fitting;

a trajectory angle setting means; and a sprinkler head, wherein:

said base component comprises a rigid flat solid planar member with an upper surface, a lower surface, one or more outer edges, an overall outer dimension, and at least one base component knuckle protrusion;

said at least one base component knuckle protrusion comprises a rigid oblong planar member extending vertically upwards from said upper surface of said base component with a cylindrical-shaped void or hole there through that is a hinge screw hole;

said lockable flow-through hinge fitting comprises a fitting body, a threaded area for a feed hose, a threaded area for said sprinkler head, and at least one hinge fitting knuckle protrusion;

said fitting body comprises a rigid, solid, hollow cylindrical member with a closed end, an open end, an interior surface, an exterior surface, and a longitudinal axis;

said open end of said fitting body has threads inscribed either along said interior surface or said exterior surface of said fitting body which is said threaded area for a feed hose;

said threaded area for said sprinkler head comprises a raised cylindrical-shaped protrusion protruding from said exterior surface of said fitting body with a longitudinal axis perpendicular to that of said fitting body;

said raised cylindrical-shaped protrusion has two open ends, an interior surface, and an exterior surface;

said raised cylindrical-shaped protrusion has threads inscribed either along said interior surface or said exterior surface of said raised cylindrical-shaped protrusion;

said at least one hinge fitting knuckle protrusion comprises a rigid oblong planar member extending radially outward from said exterior surface of said fitting body with a longitudinal axis that is perpendicular to that of said fitting body, and a cylindrical-shaped void or hole there through that is a hinge screw hole;

said hinge screw hole in said at least one base component knuckle protrusion and said hinge screw hole in said at least one hinge fitting knuckle protrusion are the same size;

said trajectory angle setting means is a lockable hinge mechanism that comprises said at least one base component knuckle protrusion, said at least one hinge fitting knuckle protrusion, and a hinge screw, whereby said lockable flow-through hinge fitting is pivotally attached to said base component by aligning said hinge screw hole in said at least one base component knuckle protrusion with said hinge screw hole in said at least one hinge fitting knuckle protrusion and placing said hinge screw through both said hinge screw holes, wherein said hinge screw is a threaded body rigidly attached to a screw head, and said threaded body is a solid rigid cylindrical member with an outer diameter and helical threads inscribed along the side of said cylindrical member;

said screw head is a solid rigid cylindrical member with an outer diameter larger than that of said threaded body, said hinge screw hole in said at least one base component knuckle protrusion, and said hinge screw hole in said at least one hinge fitting knuckle protrusion, so that said screw head interferes with and will not pass through either said hinge screw hole;

at least one said hinge screw hole of said at least one base component knuckle protrusion, or at least one hinge screw hole of said at least one hinge fitting knuckle protrusion is tapped to accept said threaded body of said hinge screw for a threaded connection thereto and is designated a tapped hinge screw hole;

said hinge screw hole in said at least one base component knuckle protrusion and said hinge screw hole in said at least one hinge fitting knuckle protrusion are positioned concentrically;

said threaded body of said hinge screw is inserted into said hinge screw hole in said at least one base component knuckle protrusion and said hinge screw hole in said at least one hinge fitting knuckle protrusion and threaded into said tapped hinge screw hole to form the lockable hinge mechanism;

said trajectory angle setting means is a means to adjust the trajectory angle of water flowing from said sprinkler head by allowing the rotation of said sprinkler head relative to said base component along at least one axis of movement thereby allowing the adjustment of the trajectory angle of water flowing from said sprinkler head and the locking or holding of a certain trajectory angle of water flowing from said sprinkler head;

said sprinkler head is a hollow vessel capable of containing a pressurized flow of liquid there through, and has one or more holes in one end through which water may flow there through, and a male or female threaded connector at an opposite end thereof, through which water may flow there through; and said sprinkler head is removeably attached to said lockable flow-through hinge fitting by threaded connection at said threaded area for said sprinkler head.

6. A retractable adjustable-trajectory rooftop fire sprinkler as recited in claim 5, comprising two said at least one base component knuckle protrusions.

7. A retractable adjustable-trajectory rooftop fire sprinkler as recited in claim 5, comprising three said at least one hinge fitting knuckle protrusions.

8. A retractable adjustable-trajectory rooftop fire sprinkler as recited in any one of claim 1, 2, 3, 4, 5, 6, or 7, further comprising: a cover component; wherein said cover component comprises a cover or bonnet that is a rigid and solid member with a closed top and an open bottom;

said open bottom has an outer surface and an inner surface;

said inner surface of said open bottom has an overall inner dimension that is sized slightly larger than said overall outer dimension of said base component, so that said open bottom of said cover component forms a press fit over said one or more outer edges of said base component; and said open bottom is removeably attachable to said base component with an overlapped press fit connection that is achieved by said open bottom of said cover component overlapping said one or more outer edges of said base component.

* * * * *